US009726350B2

(12) United States Patent
Beaumont et al.

(10) Patent No.: US 9,726,350 B2
(45) Date of Patent: Aug. 8, 2017

(54) SIGNALLING BEACON WITH DEFLECTOR

(71) Applicant: OBSTA, Sevres (FR)

(72) Inventors: Xavier Beaumont, Sevres (FR); Heinrick Burgaud, Sevres (FR)

(73) Assignee: OBSTA, Sevres (FR)

( * ) Notice: Subject to any disclaimer, the term of this patent is extended or adjusted under 35 U.S.C. 154(b) by 46 days.

(21) Appl. No.: 14/957,063

(22) Filed: Dec. 2, 2015

(65) Prior Publication Data

US 2016/0161091 A1 Jun. 9, 2016

(30) Foreign Application Priority Data

Dec. 3, 2014 (FR) ..... 14 61874

(51) Int. Cl.

| | |
|---|---|
| ***F21V 13/04*** | (2006.01) |
| ***F21V 7/00*** | (2006.01) |
| ***F21V 5/04*** | (2006.01) |
| ***F21V 7/05*** | (2006.01) |
| ***F21V 11/16*** | (2006.01) |
| *F21W 111/00* | (2006.01) |
| *F21W 111/06* | (2006.01) |

(Continued)

(52) U.S. Cl.

CPC ..... *F21V 13/04* (2013.01); *F21V 5/043* (2013.01); *F21V 7/0008* (2013.01); *F21V 7/05* (2013.01); *F21V 11/16* (2013.01); *F21W 2111/00* (2013.01); *F21W 2111/06* (2013.01); *F21Y 2103/10* (2016.08); *F21Y 2115/10* (2016.08)

(58) Field of Classification Search

CPC ..... F21V 13/04; F21V 5/043; F21V 7/0008; F21V 7/05; F21V 11/16; F21V 13/00; F21V 13/02; F21V 13/12; F21V 5/08; F21V 7/0091; F21V 7/005; F21V 11/00; F21Y 2103/10; F21Y 2115/10; F21W 2111/00; F21W 2111/06

See application file for complete search history.

(56) References Cited

U.S. PATENT DOCUMENTS

| | | | |
|---|---|---|---|
| 4,767,172 | A | 8/1988 | Nichols |
| 5,130,761 | A | 7/1992 | Tanaka |

(Continued)

FOREIGN PATENT DOCUMENTS

| | | | |
|---|---|---|---|
| CA | 2197271 | A1 | 8/1998 |
| EP | 2565519 | A1 | 3/2013 |
| NL | 6711944 | A | 3/1969 |

OTHER PUBLICATIONS

European Search Report, EP 15 19 7522.
EP 15 19 7522 Notice of Allowance dated Mar. 13, 2017.

*Primary Examiner* — Bao Q Truong
(74) *Attorney, Agent, or Firm* — Notaro, Michalos & Zaccaria P.C.

(57) ABSTRACT

A light projector intended to produce a directional flat light beam includes an elongate cylindrical lens and a linear light source parallel to the generatrix direction, extending over all or part of the length of the lens to emit light in the direction of the lens. The lens is designed to generate a principal flat light beam by concentrating the light in a predefined elevation angular sector around the horizontal generatrix direction. The light projector also includes a deflector having a rectangular plate shape positioned on the side opposite the light source. A signalling beacon including such a projector is also described.

9 Claims, 5 Drawing Sheets

(51) Int. Cl.
*F21Y 103/10* (2016.01)
*F21Y 115/10* (2016.01)

(56) References Cited

U.S. PATENT DOCUMENTS

| | | | | |
|---|---|---|---|---|
| 5,155,666 | A * | 10/1992 | Radford | B64F 1/20 362/145 |
| 5,980,069 | A | 11/1999 | Guerrero | |
| 8,766,815 | B2 * | 7/2014 | Di Giovine | F21V 29/004 320/108 |
| 9,483,919 | B2 * | 11/2016 | Di Giovine | F21V 31/04 |
| 2004/0114355 | A1 | 6/2004 | Rizkin | |
| 2006/0209541 | A1 | 9/2006 | Peck | |
| 2013/0049980 | A1 | 2/2013 | Di Giovine | |

* cited by examiner

SIGNALLING BEACON WITH DEFLECTOR

TECHNICAL FIELD

The invention relates to the field of signalling devices, notably for overhead signalling of high-tension power lines, airport buildings, factory chimneys, cranes, wind turbines and pylons.

TECHNOLOGICAL BACKGROUND

Signalling devices intended for aircraft are used on high obstacles and/or cables. Such signalling devices can notably include cylindrical lenses in order to emit focused light in a predefined direction, as illustrated by FR-A-2895779.

SUMMARY

One idea on which the invention is based is to provide a beacon emitting light that can cover all of the overhead space without being a nuisance to people in the neighbourhood. In accordance with one embodiment, the invention provides a light projector intended to produce a directional flat light beam, the projector comprising:

an elongate cylindrical lens the cylindrical shape of which is defined by a horizontal generatrix generation and by a director curve, a linear light source parallel to the generatrix direction, extending over all or part of the length of the cylindrical lens to emit light in the direction of the cylindrical lens, the cylindrical lens being adapted to generate a principal flat light beam by concentrating the light in an predefined angular sector of elevation around the horizontal generatrix direction in the direction of the space situated on the opposite side of the cylindrical lens to the light source, and being adapted to project the light in a predefined azimuth angular sector around the vertical direction, a deflector positioned in the space situated on the side opposite the light source of the cylindrical lens, the deflector having a rectangular plate shape, the longitudinal sides of the deflector being parallel to the generatrix direction, the transverse sides of the deflector being oriented around the generatrix direction in accordance with an elevation angle contained in the predefined elevation angular sector of the principal flat light beam, so as to interrupt light rays from the light source oriented outside the elevation angular sector of the principal flat light beam.

Thanks to these features, the luminous intensity emitted by the projector outside the principal flat beam can be reduced. For example, the luminous intensity at an elevation angle of −10° is made less than 3% of the luminous intensity emitted at the elevation angle of 0°, which corresponds for example to the horizontal.

In accordance with embodiments, such a light projector may have one or more of the following features.

The director curve of the lens may have numerous shapes, for example circular, elliptical, polygonal, etc.

In accordance with one embodiment, the director curve has a substantially trapezoidal overall shape, the shorter base of the trapezium being oriented toward the light source and the longer base of the trapezium being oriented in the direction of the flat light beam, the director curve including a recess defining a groove parallel to the generatrix on the shorter base of the trapezium, the back wall of the groove being a convex surface, the other two sides of the trapezium defining two inclined convex external surfaces of the cylindrical lens, the two external surfaces being adapted to reflect the light rays so as to bend the light rays into the elevation angular sector of the principal flat light beam.

In accordance with one embodiment the longer base of the trapezium is approximately 56 mm, the shorter base 20 mm and the length of the cylindrical lens approximately 200 mm.

In accordance with one embodiment, the cylindrical lens has a horizontal plane of symmetry.

In accordance with one embodiment, the linear source is in the horizontal plane of symmetry.

In accordance with one embodiment, the elevation angular sector is defined as the angular sector in which the luminous intensity is greater than 50% of the luminous intensity at the centre of the flat light beam, the azimuth angular sector is defined as the angular sector in which the luminous intensity is greater than 50% at the centre of the flat light beam, and the width of the elevation angular sector is less than 10°, preferably less than 3°.

Thanks to these features of concentration of the luminous energy in an elevation angular sector, the energy consumed by the beacon is optimized.

In accordance with one embodiment, the deflector is a metal blade.

The deflector may have any dimensions suited to its purpose. In accordance with one preferred embodiment, the length of the deflector is substantially equal to the length of the lens. The deflector should preferably cover all of the solid angle in which unwanted light is present. The deflector may also consist of a plurality of plates.

In accordance with one embodiment, the ratio between the length of the deflector and the width of the deflector is approximately 2 to 20.

In accordance with one embodiment, the ratio between the length of the deflector and the thickness of the deflector is approximately 100 to 1000. Thanks to these features, the overall mechanical size of the beacon is limited at the same time as making it possible to prevent unwanted light rays.

Thanks to this positioning, the interruption of the unwanted light is statistically improved.

The positioning of the deflector relative to the lens may be chosen as a function of the specific properties of the unwanted light emitted, for example with the aid of experimental measurements.

In accordance with one embodiment, the deflector is at a distance from a horizontal plane containing the light source less than 25% of the greatest vertical dimension of the cylindrical lens.

In accordance with one embodiment, the invention also comprises a beacon comprising a support and a plurality of the projectors referred to above fixed to the support, the projectors being oriented in distinct directions about a vertical axis so that the azimuth angular sectors of the projectors cover 360° around the vertical axis.

Certain aspects of the invention start from the idea of providing an obstacle to light beams directed in directions at an elevation angle less than −10° relative to the central direction of the principal flat beam without producing an obstacle to the flat light beam about the central elevation angle. The light beams directed in directions at an elevation angle of less than −10° may notably arise from unwanted reflections in the cylindrical lens.

BRIEF DESCRIPTION OF THE FIGURES

The invention will be better understood, and other objects, details, features and advantages thereof will become more clearly apparent in the course of the following description of particular embodiments of the invention given by way of nonlimiting illustration only with reference to the appended drawings.

DETAILED DESCRIPTION OF EMBODIMENTS

Figure 1:
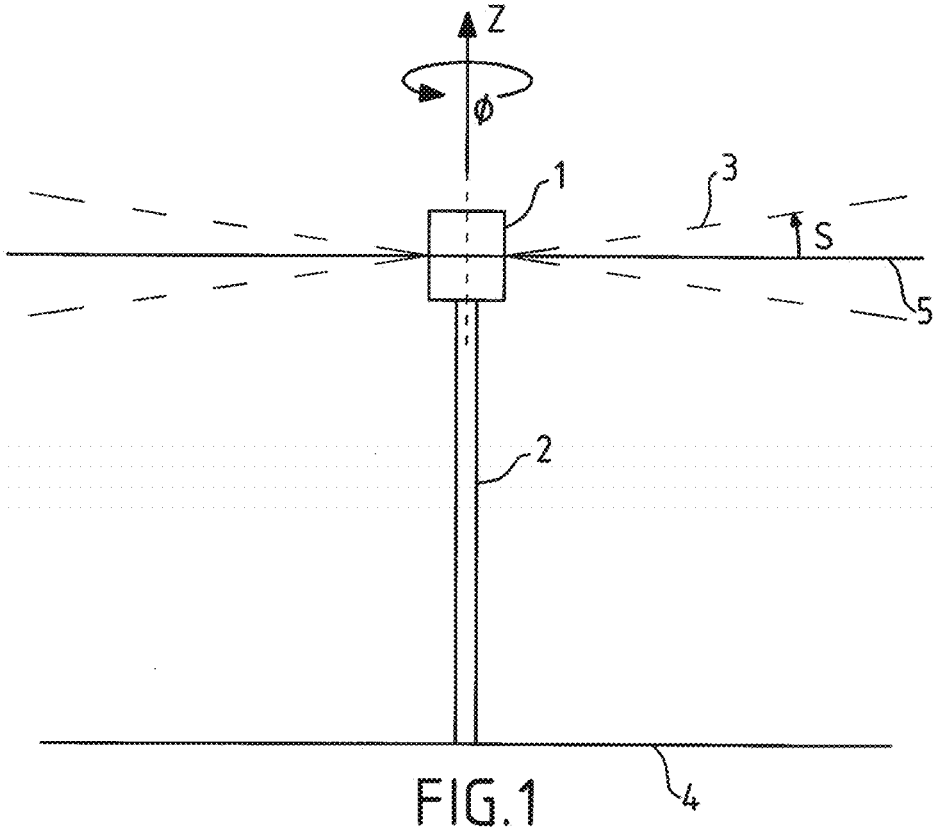
FIG. 1 is a diagram of a beacon mounted on a post having a vertical axis z.

Referring to FIG. 1, a beacon 1 mounted on a post 2 with a vertical axis z embedded in the ground 4 is shown. The beacon 1 emits a flat light beam 3 all around the vertical axis, which corresponds to an azimuth angular sector $\phi$ of 360°. The flat light beam 3 is represented by dashed lines. The flat light beam 3 is concentrated in an elevation angular sector of elevation angle s centred on a central direction, which is for example a plane 5 that is horizontal or slightly inclined relative to the horizontal. The flat light beam 3 has for example a luminous intensity of 20 000 cd in the colour white and of 2 000 cd in the colour red. The luminous intensity and the colour may be adjusted according to whether it is daytime or night time. This beacon 1 notably makes possible overhead signalling intended for aircraft.

Figure 2:
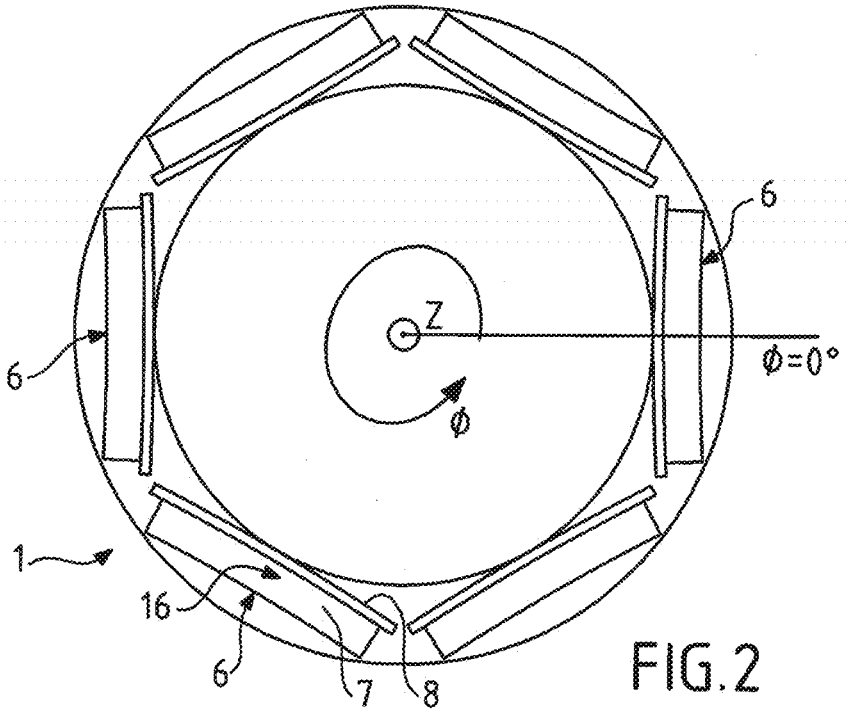
FIG. 2 is a top view of one embodiment of the beacon that comprises 6 projectors.

Referring to FIG. 2, in an illustrative example, the beacon 1 is represented in more detail. Such a beacon includes six projectors 6 each including a linear light source. In this illustrative example, the linear light source is a strip 16 of light-emitting diodes and a cylindrical optic 7. The projectors 6 are arranged in a plane perpendicular to the axis z so that the strips 16 of diodes form a regular polygon and emit light toward the outside of the regular polygon. Each projector 6 emits an elementary flat light beam in a defined azimuth angular sector. The beacon emits a 360° directional flat light beam corresponding to the combination of the elementary flat light beams of each projector 6 of the beacon 1. To this end, the minimum azimuth angular sector of each of the six projectors 6 is 360° divided by the number of projectors 6. In this illustrative example the beacon comprises six projectors 6 and the minimum azimuth angular sector is therefore 60°, i.e. 360°/6. In this illustrative example, the beacon 1 has an overall size of approximately 50 cm. In each projector, the assembly formed by the diode strip 16 and the cylindrical lens 7 is protected by an opaque metal module 8 open in the direction of emission of the light. The opening of the module may be covered by a glass that does not deflect the light, in order to protect the cylindrical lens from dust.

Figure 3:
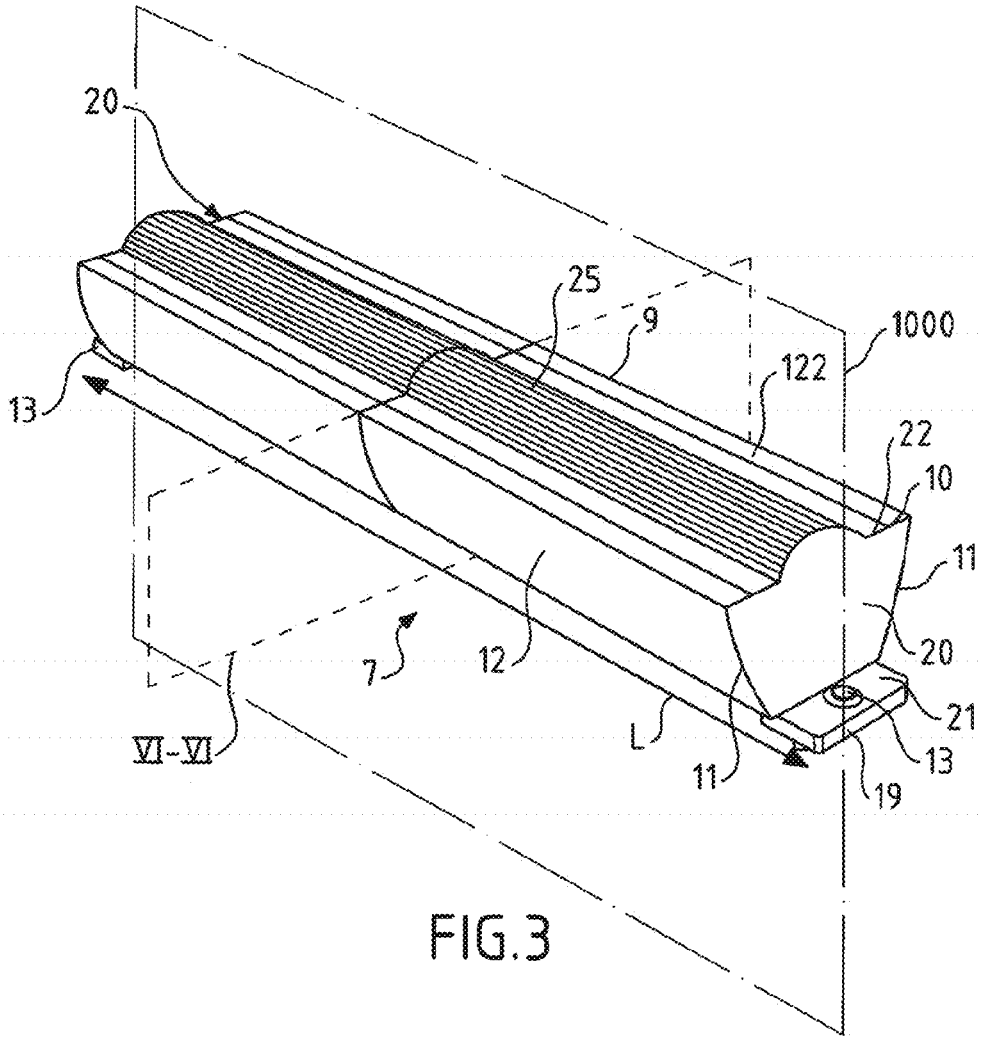
FIG. 3 is a perspective view of the cylindrical optic of a projector of the beacon in accordance with one embodiment.

Referring to FIG. 3, in an illustrative example, a cylindrical lens 7 of a projector 6 is represented. The cylindrical lens 7 has a length L. The cylindrical shape is defined by a horizontal generatrix direction 9 and by a director curve 10. The cylindrical lens 7 includes two end faces 20 perpendicular to the generatrix 9 of the cylinder. The cylindrical lens 7 consists mainly of polycarbonate. In this illustrative example, the cylindrical lens 7 measures approximately 200 mm. The director curve 10 has a substantially trapezoidal overall shape. The longer base 22 of the trapezium measures approximately 56 mm and the shorter base 21 of the trapezium measures approximately 25 mm. The sides 11 of the trapezium define two inclined convex external surfaces 12 of the cylindrical lens. The shape of the director curve 10 will be explained in more detail later with reference to FIG. 6. The cylindrical lens 7 has orifices 13 on a support 19. The orifices 13 are intended to receive fixing means fixing the cylindrical lens 7 and a strip 16 of diodes as shown in FIG. 4.

In this illustrative example, the diode strip 16 includes diodes 14, 15 aligned in a linear manner on a plate 17 so as to constitute a linear light source. The diodes of the strip 16 are red diodes 14 successively separated by four respective white diodes 15. The strip 16 also includes orifices 18 so that it can be fixed to the support 19 of the cylindrical lens shown in FIG. 3 stacked with the orifices 13 present on the support 19.

Figure 4:
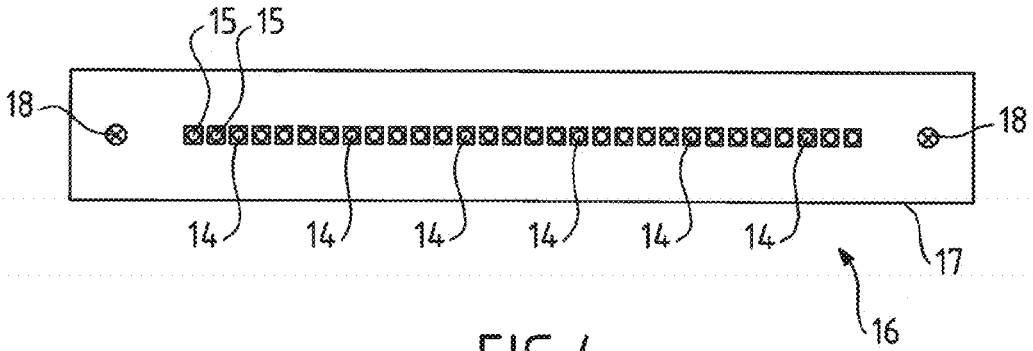
FIG. 4 is a top view of a strip of LEDs that is fixed to the cylindrical optic of the projector shown in FIG. 3.
Figure 5:
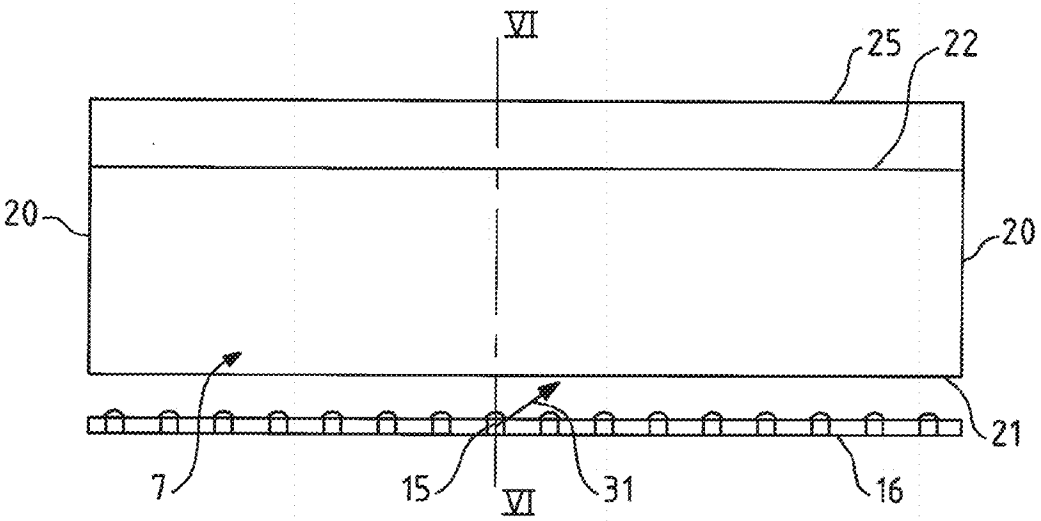
FIG. 5 shows from the front the assembly of the cylindrical optic of the projector and the strip of LEDs shown in FIGS. 3 and 4, respectively.

FIG. 5 is a diagrammatic representation of the assembly of the cylindrical lens 7 represented in FIG. 3 and the strip 16 of diodes represented in FIG. 4. The strip 16 of diodes is fixed to the cylindrical lens 7 so that the surface of the cylindrical lens 7 defined by the shorter base 21 of the trapezium faces the face of the strip 16 of diodes that emits light.

The subsequent figures show in more detail the structure of a projector 6 in operation, the projector 6 comprising the cylindrical lens 7 as shown in FIG. 3 and the strip 16 of diodes as shown in FIG. 4. The projector 6 is operating when the diodes 14, 15 of the strip 16 of diodes emit light.

Figure 6:
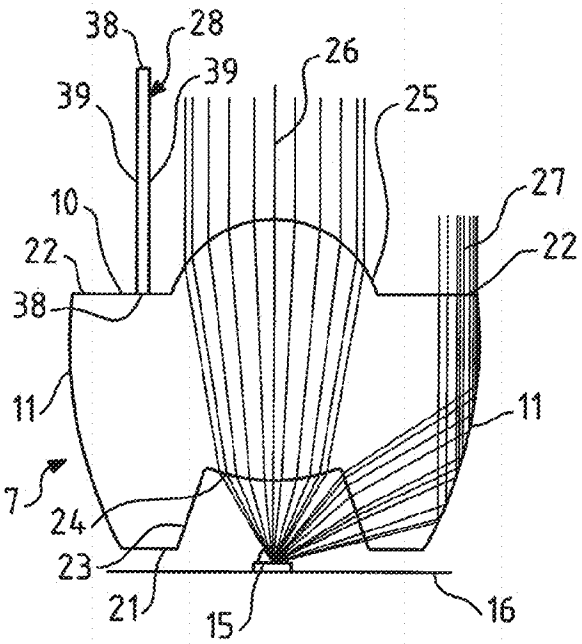
FIG. 6 is a view in section on the section plane VI-VI of the assembly shown in FIG. 5, in which are shown the trajectories of the light beams coming from an LED via the cylindrical optic.

FIG. 6 is a section on the plane VI-VI of the assembly shown in FIG. 5 showing the trajectories of the light beams from the diode 15 through the cylindrical optic.

The shorter base 21 of the trapezium is oriented toward the diode 15. The longer base 22 of the trapezium is oriented in the direction of the flat light beam. The director curve 10 includes a recess 23 on the shorter base 21 of the trapezium. This recess defines a groove parallel to the generatrix 9 on the cylindrical lens 7. The back wall of the groove is a convex surface 24 in order to cause convergence of the rays from the strip 16 of diodes in the form of the elementary flat light beam. In the section plane VI-VI, the rays 26 from the diode 15 in an elevation angular sector approximately centred on the direction perpendicular to the strip 16 are therefore coupled to the convex interface 24 and concentrated by a second convex interface 25 situated on the longer base 22 of the trapezium, after propagating in the cylindrical lens substantially perpendicularly to the generatrix 9. The light rays 26 therefore exit the cylindrical lens 7 in an elevation angular sector approximately centred on the direction perpendicular to the strip 16.

The light rays 27 from the diode 15 in the plane VI-VI and in the direction at 45° to the perpendicular to the strip 16 are coupled by the lateral edges of the recess 23 and bent toward the sides 11 of the trapezium. The surfaces of the two sides 11 reflect the light rays because of the angle of incidence of the light rays on these surfaces. The reflected rays are therefore bent in the direction approximately perpendicular to the strip 16, so that they emerge from the lens 7 via the longer base 22 of the trapezium, crossing a non-convex interface, in an elevation angular sector approximately centred on the direction perpendicular to the strip 16.

Accordingly, in the section plane VI-VI, the light rays 26 and 27 exit the cylindrical lens 7 in a predefined elevation angular sector substantially centred on the direction perpendicular to the strip 16. These rays 26 and 27 define an elementary flat light beam. In other words, the cylindrical lens 7 has a collimator function.

A deflector 28, consisting of a metal blade, for example, is positioned on the surface 122 defined by the longer base 22 of the trapezium. The deflector 28 has a thickness that is small relative to the dimensions of the lens 7 so that the wanted light rays are not interrupted, for example 0.5 mm thick, a length substantially equal to that of the cylindrical lens, i.e. 200 mm, and a width of 20 mm. The longitudinal sides 39 of the deflector are parallel to the generatrix. The transverse sides 38 of the deflector are oriented around the generatrix direction in the direction of transmission of the light rays 26 exiting the cylindrical lens 7. The deflector 28 therefore does not interrupt the light rays 26 and 27 because it is parallel to the direction perpendicular to the strip 16, and therefore to the principal direction of the elementary flat light beam from the projector 6.

The director curve has an axis 100 of symmetry perpendicular to the strip 16 so that the cylindrical lens 7 has a first plane 1000 of symmetry generated by two generatrices. This amounts to saying that the director curve 10 has substantially an isosceles trapezium shape. The cylindrical lens 7 also has a second plane of symmetry, which is the section plane IV-IV, intersecting the cylindrical lens at the half-length L/2. In effect, the two end faces 20 are perpendicular to the generatrix of the cylinder.

Figure 7:
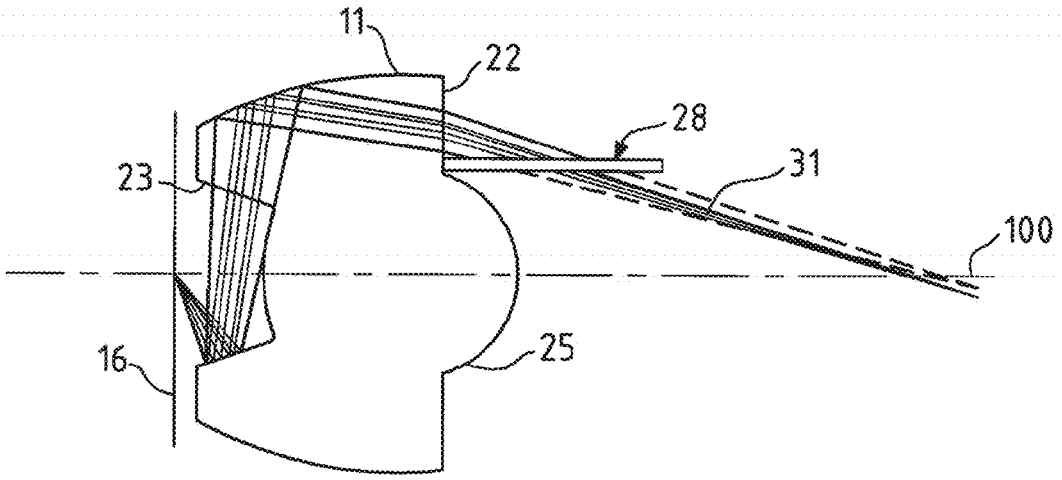
FIG. 7 shows a section on the section plane VI-VI of the cylindrical optic showing in projection the light beams from the central LED of the strip of LEDs in the direction of azimuth angle 45° through the optic.

FIG. 7 represents a section on the plane VI-VI of the cylindrical optic identical to FIG. 4. In this FIG. 7 there are represented projected onto the section VI-VI the light rays 31 from the centre diode 15 of the strip 16 of diodes in the direction with the azimuth angle of 45° through the optic. The light rays 31 produce unwanted luminous intensity at the elevation angle s=−10° greater than 3% of the luminous intensity at the location of the maximum intensity of the elementary flat light beam, i.e. at the elevation angle s=0°. The elevation angle s is defined relative to the horizontal 5 corresponding to the elevation angle s=0°. Unwanted light is defined as light outside the predefined elevation angular sector of the elementary flat light beam whose luminous intensity is greater than 3% of the maximum luminous intensity in the predefined elevation angular sector.

The deflector 28 is opaque: the light rays 31 that encounter it do not pass through it. They are represented artificially in FIG. 7 to explain the origin of the unwanted luminous intensity that is prevented by placing the deflector 28 on the cylindrical lens 7.

In accordance with a preferred embodiment, the deflector 28 consists of a reflective metal blade in order to reflect the light rays 31 upward (not shown). The advantage of a deflector that reflects the unwanted light rays 31 is to limit the absorption of the luminous energy of the unwanted rays and therefore the heating of the deflector 28. The effects of the presence of the deflector 28 will now be shown.

Figure 8:
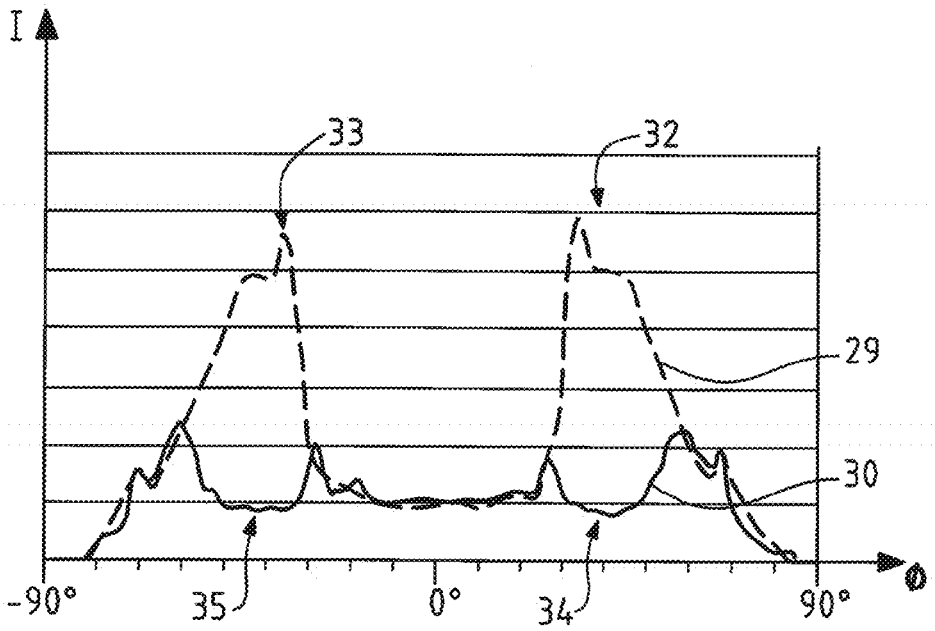
FIG. 8 is a graph showing the measured luminous intensity from a projector at the elevation angle −10° as a function of the azimuth angle for a projector fitted with a deflector and for a second projector identical to the first not fitted with a deflector.

In effect, referring to FIG. 8, a curve 29 represents a measurement of the luminous intensity I leaving a projector 6 at the elevation angle s=−10° as a function of the azimuth angle ϕ for a projector 6 not equipped with a deflector 28. This projector 6 includes a cylindrical lens 7 and a strip 16 of diodes as shown in the examples referring to FIGS. 3 and 4. The horizontal axis is graduated in steps of 10°.

A second curve 30 represents a measurement of the luminous intensity I leaving an identical projector 6, at the elevation angle s=−10°, as a function of the azimuth angle ϕ, with the difference, compared to the first curve 29, that this time the projector is equipped with a deflector 28 as described with reference to FIGS. 6 and 7. This deflector 28 is situated 3 mm from the axis 100 of symmetry.

The two curves 29 and 30 of luminous intensity were measured with the projector 6 in operation, over an azimuth angle range of 180°, the range being centred on the azimuth angle ϕ=0° defined in the section plane IV-IV. The luminous intensity I has been represented without units, so as to show the relative variations of intensity between the projector 6 equipped with a deflector 28, i.e. the intensity represented by the curve 30, and the projector 6 without the deflector 28, i.e. the intensity represented by the curve 29. The curve 29 includes two intensity peaks 32 and 33 on respective opposite sides of the azimuth angle ϕ=0, the maximum value of which is 6 times greater than the value of the luminous intensity at the azimuth angle ϕ=0. The two intensity peaks 32 and 33 are centred on −35° and 35°, respectively. By way of contrast, the luminous intensity 34 and 35 on the curve 30 around the same respective azimuth angles, i.e. −35° and 35°, is equal to the luminous intensity I at the azimuth angle ϕ=0.

Comparing these curves 29 and 30 therefore shows that the deflector 28 makes it possible to prevent unwanted light at the elevation angle s=−10°.

Figure 9:
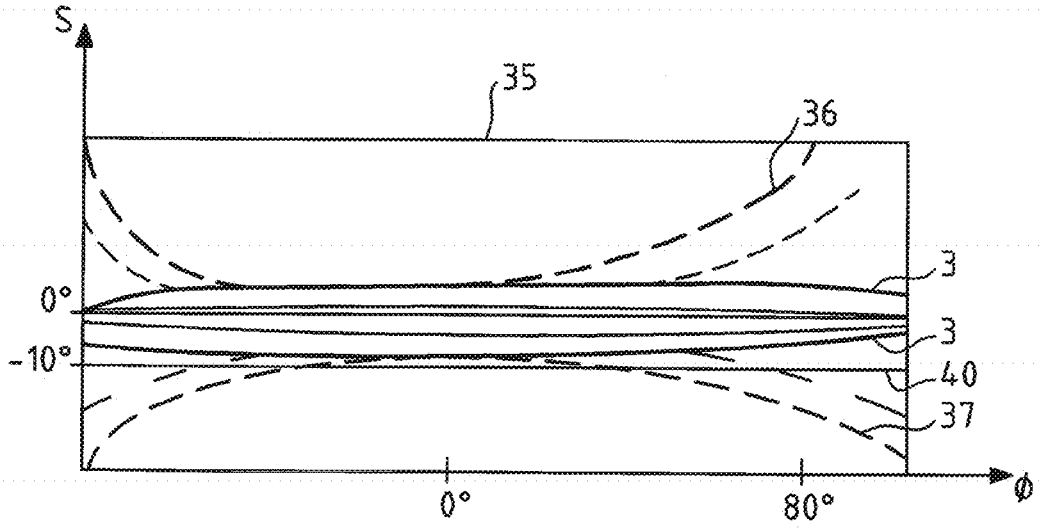
FIG. 9 shows the iso-intensity curves of the light from a projector not equipped with a deflector.

Referring to FIG. 9, the iso-intensity curves of the light from the projector 6 not equipped with the deflector 28 are represented on a screen 35. In the horizontal direction a position is identified on the screen 35 by the azimuth angle ϕ and in the vertical direction a position is identified on the screen by the elevation angle s. The elevation angle s=0 corresponds to the horizontal plane and the azimuth angle ϕ=0 corresponds to the section plane IV-IV. The curve 29 from FIG. 8 is a representation of the luminous intensity along the line 40 from FIG. 9.

The light is mainly directed toward an elevation angular sector less than 10° and centred on the elevation angle s=0, as shown by the bold curves 3 delimiting the predefined elevation angular sector of the elementary flat light beam.

Unwanted light is also emitted outside this angular sector, as the dashed line curves 36 and 37 show.

Figure 10:
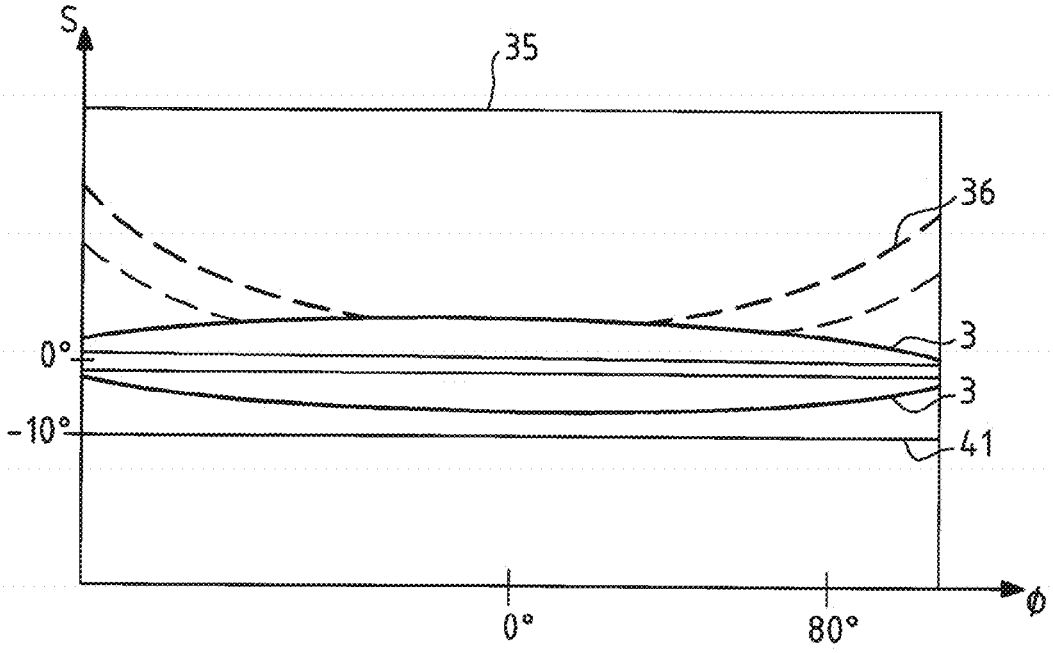
FIG. 10 shows the iso-intensity curves of the light from a projector equipped with a deflector.

Referring to FIG. 10, the iso-intensity curves of the light from the projector 6 equipped with a deflector 28 are represented. As in FIG. 9, the light is mainly directed toward an elevation angular sector less than 10° and centred on the elevation angle s=0°, as shown by the bold curves 3 delimiting the predefined elevation angular sector of the elementary flat light beam. The curve 30 from FIG. 8 is a representation of the luminous intensity along the line 41 from FIG. 10.

Unwanted light is also emitted outside this predefined elevation angular sector, for positive elevation angles greater than 10°, as the dashed line curve 36 shows. No unwanted light is to be deplored for negative elevation angles less than 10°. The deflector 28 positioned above the axis 100 of symmetry therefore makes it possible to eliminate the unwanted rays 31 caused by the luminous intensity of the unwanted light represented by the curve 37. The position of the deflectors shown in FIG. 7 is not imperative.

The position of the deflector 28 relative to the centre plane of the elementary flat light beam can be determined using experimental luminance measurements for elevation angles less than and equal to −10° by placing the deflector in different positions. In order to be able to interrupt the unwanted light rays 31 directed downwards from an upper side 11 of the cylindrical lens 7, the deflector 28 is always positioned below the maximum of the side 11.

For example, in the illustrative embodiment from FIG. 7, the deflector 28, which is positioned above the axis 100 of symmetry as previously explained, is placed below the maximum of the upper convex external surface 12 of the cylindrical lens 7. The deflector 28 is also placed above the second convex interface 25. The deflector 28 is placed at approximately ⅔ of the height of the first convex interface 22 starting from the top, as shown.

The deflector 28 is oriented so that the metal plate constituting it is substantially parallel to the direction of the light rays from the centre of the elementary flat light beam so as not to obstruct the substantially horizontal wanted light rays, but only the unwanted light rays oriented in a negative elevation angle. The deflector can nevertheless be slightly inclined relative to the centre direction of the flat beam, preferably at an angle less than the aperture angle of the principal flat beam containing 50% of the intensity.

The beacons described above can be produced with numerous types of light sources, notably LEDs, fluorescent tubes, discharge lamps, etc. The light may be of different colours, blinking or not, depending on the required lighting characteristics.

In another embodiment, the linear light source is not exactly centred on the plane 1000 of symmetry. The principal direction of the elementary flat light beam is therefore not exactly horizontal.

In another embodiment, the lens has no first plane of symmetry. In another embodiment, the lens has no second plane of symmetry.

The linear light source is preferably placed on a focusing line of the cylindrical lens. The focusing line is defined by a line on which light rays coming from infinity converge after passing through the cylindrical lens in the propagation direction opposite to the at described above for the emission of light from the projectors.

The cylindrical lens may be manufactured in numerous materials, for example glass, polycarbonate, transparent flexible resin, for example flexible resin including polyurethane compounds, for example a VT3402 series resin.

The beacon 1 from FIG. 1 may be produced with any number of projectors greater than 2. In another embodiment, the projectors may be stacked vertically so that the principal directions of the azimuth angular sectors of the flat light beams emitted are offset with respect to one another by an angle sufficient for the combination of the flat light beams emitted by each of the projectors of the beacon to be emitted in a total azimuth angle $\phi$ of 360°.

The cylindrical lens may have different shapes.

In another embodiment, the director curve has a substantially quadrilateral shape. In another embodiment, the director curve is elliptical. In another embodiment, the director curve is a circle.

In another embodiment, the cylindrical lens consists of an assembly of cylindrical lenses coupled to one another.

Although the invention has been described in connection with a number of particular embodiments, it is obvious that it is in no way limited to these and that it encompasses all technical equivalents of the means described and their combinations if the latter are within the scope of the invention.

The use of the verb "include" or "comprise" or their conjugate forms does not exclude the presence of other elements or other steps than those set out in a claim. The use of the indefinite article "a" or "an" for an element or a step does not exclude the presence of a plurality of such elements or steps, unless otherwise indicated.

In the claims, any reference sign between parentheses should not be interpreted as a limitation of the claim.

The invention claimed is:

1. Light projector (6) intended to produce a directional flat light beam (3) for signalling tall obstacles, the projector comprising:

an elongate cylindrical lens (7) the cylindrical shape of which is defined by a horizontal generatrix direction (9) and by a director curve (10), the cylindrical lens (7) having a horizontal plane (100, 1000) of symmetry, a linear light source (14, 15) parallel to the generatrix direction (9), extending over all or part of the length (L) of the cylindrical lens (7) to emit light in the direction of the cylindrical lens (7), the cylindrical lens (7) being adapted to generate a principal flat light beam (26, 27) by concentrating the light in a predefined elevation angular sector around the horizontal generatrix direction (9) in the direction of the space situated on the opposite side of the cylindrical lens to the light source, and being adapted to project the light in a predefined azimuth angular sector around the vertical direction, characterized in that it further comprises a deflector (28) comprising a metal blade, positioned in the space situated on the side opposite the light source (15) of the cylindrical lens, the deflector having a rectangular plate shape, the longitudinal sides of the deflector being parallel to the generatrix direction (9), the transverse sides of the deflector being oriented around the generatrix direction in accordance with an elevation angle (s) contained in the predefined elevation angular sector (s) of the principal flat light beam (26, 27), the deflector further being positioned above the horizontal plane of symmetry of the cylindrical lens and below the upper surface of the cylindrical lens so as to interrupt light rays (31) from the light source (15) oriented outside the elevation angular sector (s) of the principal flat light beam (26, 27).

2. Light projector according to claim 1, wherein the director curve (10) has a substantially trapezoidal overall shape, the shorter base (21) of the trapezium being oriented toward the light source (14, 15) and the longer base (22) of the trapezium being oriented in the direction of the flat light beam (26, 27), the director curve (10) including a recess (23) defining a groove parallel to the generatrix (9) on the shorter base (21) of the trapezium, the back wall of the groove being a convex surface (24), the other two sides (11) of the trapezium defining two inclined convex external surfaces (12) of the cylindrical lens (7), the two external surfaces being adapted to reflect the light rays so as to bend the light rays (27) into the elevation angular sector of the principal flat light beam (26, 27).

3. Light projector according to claim 2, wherein the longer base (22) of the trapezium is approximately 56 mm, the shorter base (21) 20 mm and the length (L) of the cylindrical lens (7) approximately 200 mm.

4. Light projector according to claim 3, wherein the linear source (14, 15) is in the horizontal plane (100, 1000) of symmetry.

5. Light projector according to claim 1, the elevation angular sector (s) being defined as the angular sector in which the luminous intensity is greater than 50% of the luminous intensity at the centre of the flat light beam (26, 27), the azimuth angular sector (ϕ) being defined as the angular sector in which the luminous intensity is greater than 50% at the centre of the flat light beam, the elevation angular sector being less than 10°, preferably less than 3°.

6. Light projector according to claim 1, wherein the ratio between the length of the deflector (28) and the width (39) of the deflector is approximately 2 to 20 and the ratio between the length of the deflector and the thickness (38) of the deflector is approximately 100 to 1000.

7. Light projector according to claim 1, wherein the deflector (28) is at a distance from a horizontal plane (100, 1000) containing the light source (14, 15) less than 25% of the greatest vertical dimension (22) of the cylindrical lens.

8. Light projector according to claim 1, wherein the length of the deflector (28) is substantially equal to the length of the lens.

9. Beacon (1) comprising a support and a plurality of projectors (6) according to claim 1 fixed to the support, the projectors (6) being oriented in distinct directions (ϕ) about a vertical axis (z) so that the azimuth angular sectors (ϕ) of the projectors cover 360° around the vertical axis (z).

* * * * *